US005857340A

United States Patent [19]

Garrett

[11] Patent Number: 5,857,340

[45] Date of Patent: Jan. 12, 1999

[54] PASSIVE FREQUENCY STABILIZATION IN AN ACOUSTIC RESONATOR

[76] Inventor: Steven L. Garrett, P.O. Box 10271, State College, Pa. 16805

[21] Appl. No.: 967,674

[22] Filed: Nov. 10, 1997

[51] Int. Cl.[6] ..... F25B 9/00

[52] U.S. Cl. ..... 62/6; 62/467

[58] Field of Search ..... 62/6, 467, 480; 60/516

[56] References Cited

U.S. PATENT DOCUMENTS 5,647,216 7/1997 Garrett ..... 62/6

5,673,561 10/1997 Moss ..... 62/6

*Primary Examiner*—William Doerrler

[57] ABSTRACT

The resonance frequency of a gas-filled acoustic resonator (12) is stabilized against changes in frequency due to changes in the temperature of the gas and resonator (12) by placing a gas mixture and an adsorbent (16) within the resonator (12). If the temperature dependence of the adsorbency is different for the different species comprising the gas mixture, then it is shown that the proper amount of adsorbent (16) can maintain the acoustic resonant frequency of the gas mixture within resonator (12) very nearly equal to a constant frequency.

12 Claims, 4 Drawing Sheets

PASSIVE FREQUENCY STABILIZATION IN AN ACOUSTIC RESONATOR

BACKGROUND—FIELD OF INVENTION

This invention relates to the use of an adsorbent and a gas mixture to stabilize the frequency of an acoustic resonator which is subject to temperature changes and will be particularly useful in thermoacoustic refrigerators and prime movers.

BACKGROUND—DESCRIPTION OF PRIOR ART

Over the past fifteen years, a new class of refrigerators and heat engines have been developed [Wheatley, et al., U.S. Pat. No. 4,398,398 and 4,489,553]. These devices utilize intrinsically irreversible thermal conduction to provide the proper phasing between pressure and volumetric velocity. This phasing will produce useful quantities of cooling or generate mechanical work. These new engines are called thermoacoustic engines. Earlier engines required mechanical means such as pistons, linkages, displacers, cams, valves and other mechanisms to realize useful cooling or produce mechanical work using more traditional reversible heat engine cycles (e.g., Stirling Cycle or Rankine Cycle).

Sound Speed Variation with Temperature

All of the thermoacoustic engines produced to date which operated as prime movers generated power at an acoustic frequency which varied with the internal temperature of the engine [e.g., Swift, J. Acoust. Soc. Am., Vol 92, 1551–1563 (1992)]. In this context, a prime mover is an engine which converts heat to mechanical work. For a thermoacoustic prime mover, that mechanical work will be manifest as the production of sound waves. The variation in operating frequency of a thermoacoustic prime mover was due to the fact that the speed of sound, c, is a function of absolute (Kelvin) temperature, T. For an ideal gas, which is the most common working fluid in a thermoacoustic prime mover or refrigerator, the sound speed can be expressed as $$c^2 (\gamma R\ T)/M \tag{1}$$

In equation (1), $\gamma$ is the ratio of the specific heat at constant pressure to the specific heat at constant volume, R is the Universal Gas Constant (R=8.3145 J/mole-°K.), and M is the molecular weight of the gas.

The variation in the thermoacoustic oscillation (operation) frequency of the prime mover can be inconvenient if it is required to generate electrical power at a fixed frequency. For this application, the sound produced by the thermoacoustic prime mover would be converted to electrical power by an electric alternator which would function like a microphone, but at much higher powers. As the temperature changed, the frequency would change in accordance with equation (1), and the frequency of the alternating current generated by such a device would change. The Passive Frequency Stabilization technique to be described here could also be used to stabilize the resonant frequency of such a device or the resonance frequency of a sonic compressor [Lucas, U.S. Pat. No. 5,319,938 and Lucas and Van Doren, U.S. Pat. No. 5,515,684], but its most obvious and immediate application would be to resonance frequency stabilization of thermoacoustic refrigerators [e.g., Moss, U.S. Pat. No. 5,673,561; Garrett, U.S. Pat. No. 5,647.216, Chrysler, et al., U.S. Pat. No. 5,303,555; Bennett, U.S. Pat. No. 5,165,243; Hofler, et al., U.S. Pat. No. 4,722,201; Wheatley, et al., U.S. Pat. No. 4,398,398, etc.]

Electronic Frequency Tracking

The acoustic resonance in almost all thermoacoustic refrigerators is maintained by some electrical means such as a loudspeaker. To date, the frequency of the current or voltage applied to the loudspeaker has been varied so that the resonance frequency could be tracked as the temperature of the refrigerator changed. The most popular means of tracking the resonance frequency has been a phase-locked-loop (PLL) which sensed the phase of the pressure at the loudspeaker relative to the phase of the loudspeaker's acceleration. At resonance, the phases of those two quantities should be in quadrature, corresponding to a 90° phase difference between pressure and acceleration. The typical phase-locked-loop circuitry would produce an error signal which was proportional to the sine of this phase difference, since sin 90°=0, and apply this time-integrated error signal to the control input of a voltage-controlled-oscillator (VCO). This feedback arrangement would force the output frequency of the VCO to be equal to the acoustic resonance frequency of the gas within the thermoacoustic refrigerator, as that frequency changed with refrigerator temperature. A frequency tracking system of this type was used in the Space Thermo Acoustic Refrigerator and is described by Garrett, et al., J. Thermophys. Heat Transfer, Vol. 7, No. 4, 595–599 (1993).

This frequency tracking circuitry along with its associate sensors (microphone and accelerometer), signal conditioning electronics (pre-amplifiers, power supplies and filters), VCO and power amplifier (to amplify the current and voltage of the signal produced by the VCO and apply it to the loudspeaker), were required to keep the thermoacoustic refrigerator operating at resonance. Operation at acoustic resonance is important because the refrigerator will have it highest efficiency and power density when operated at the acoustic resonance frequency.

These transducers, signal processing circuitry and large power amplifier increase the complexity and cost of the thermoacoustic refrigerator. Such frequency tracking systems also introduce additional potential failure modes.

OBJECTS AND ADVANTAGES

The object of this invention is to create an entirely passive, closed-loop feedback control system which will keep the resonance frequency of an acoustic resonator, and particularly a thermoacoustic resonator, at a constant value, even though the operating temperature of the resonator and the enclosed working fluid are varying, due to changes in temperature.

Passive Stabilization

The entirely passive frequency stabilization system which is described herein requires neither transducers (e.g., accelerometers, microphones or thermometers) nor electronic signal conditioning and processing circuitry. Since the frequency is stabilized against changes in temperature, a power amplifier may not be required, since the operation at resonance would occur at a fixed frequency. One advantage of such stabilization would be obvious if the fixed resonance frequency was chosen to be the standard power-line frequency (e.g., 60 Hz in America or 50 Hz in Europe). Operation at power-line frequency could eliminate the need for a power amplifier which could then be replaced by a simple (passive) transformer that would be both cheaper, more robust, and have a higher electrical efficiency than the more complex power amplifier.

Compatibility with Gas Mixtures

Since 1988, it has been known that the efficiency of thermoacoustic engines and refrigerators is improved through the use of inert gas mixtures [M. Susalla, "Thermodynamic improvements for the Space Thermoacoustic Refrigerator (STAR)," Master's Thesis, Naval Postgraduate School, DTIC Report No. AD A 196 958 (June, 1988) and Garrett, et al., J. Thermophys. Heat Transfer, Vol. 7, No. 4, 595–599 (1993)]. This advantage in efficiency, realized by gas mixtures over pure gases, is due to the fact that the Prandtl Number can be reduced in a mixture of a gases of high and low atomic mass [Giacobbe, J. Acoust. Soc. Am., Vol. 96, No. 6, 3568–3580 (1994)]. The Prandtl Number characterizes the relative effects of the thermal conductivity (useful) to the viscosity (dissipative) of the gas or gas mixture. Based on the fundamental equations governing thermoacoustic heat transfer [see Swift, J. Acoust. Soc. Am., Vol. 84, No. 4, 1145–1180 (1988)], the efficiency of a prime mover or coefficient-of-performance of a refrigerator or heat pump can be significantly improved if the working fluid (gas) has a lower Prandtl Number.

It has also been claimed [Garrett U.S. Pat. No. 5,647,216] that the use of gas mixtures simplifies the design of high-power thermoacoustic refrigerators by providing the refrigerator designer with the option of matching the electroacoustical driver's mechanical resonance frequency to the acoustic resonance frequency-of the thermoacoustic resonator, thereby increasing overall electroacoustic coupling efficiency. The use of gas mixtures also allows the refrigerator designer flexibility in choosing the size (length) of the resonator to conform to other design constraints dictated by a specific application (e.g., the entire device must be smaller than a breadbox, deli case, etc.).

List of References

Provided below for convenience are alphabetized lists of the materials which are referenced in this patent application. The first list contains only U.S. Patents. The second contains all other literature references.

Patents

Bennett, G. A., "Compact acoustic refrigerator," U.S. Pat. No. 5,165,243 (Nov. 24, 1992)

Chrysler, G. M. and Vader, D. T., "Electronics package with improved thermal management by thermoacoustic heat pumping," U.S. Pat. No. 5,303,555 (Apr. 19, 1994)

Garrett, S. L., "High-power thermoacoustic refrigerator," U.S. Pat. No. 5,647,216 (15 Jul., 1996)

Hofler, T. J., Wheatley, J. C., Swift, G. W. and Migliori, A., "Acoustic cooling engine," U.S. Pat. No. 4,722,201 (Feb. 2, 1988)

Lucas, T. J., "Acoustic resonator having mode-alignment-canceled harmonics," U.S. Pat. No. 5,319,938 (Jun. 14, 1994)

Lucas, T. J. and Van Doren, T. W., "Resonant macrosonic synthesis," U.S. Pat. No. 5,515,684 (May 14, 1996)

Moss, W. C., "Thermoacoustic refrigerator," U.S. Pat. No. 5,673,561 (Oct. 7, 1997)

Wheatley, J. C., Swift, G. W. and Migliori, A., "Acoustical heat pumping engine," U.S. Pat. No. 4,398,398 (Aug. 16, 1983)

Wheatley, J. C., Swift, G. W. and Migliori, A., "Intrinsically irreversible heat engine," U.S. Pat. No. 4,489,553 (Dec. 25, 1984)

Wheatley, J. C., Swift, G. W. Migliori, A. and Hofler, T. J. "Heat-driven acoustic cooling engine having no moving parts," U.S. Pat. No. 4,858,441 (Aug. 22, 1989)

Scientific Literature

Berg, R. F., "Acoustic loss due to a charcoal adsorbent," Section D of "Properties of working fluids for thermoacoustic refrigerators," submitted to the Office of Naval Research under contracts PE 61153N, G N00014-93-F-0101, and TA 3126974 (1996)

Garrett, S. L., Adeff, J. A. and Hofler, T. J., "Thermoacoustic refrigerator for Space Applications," J. Thermophys. Heat Transfer, Vol. 7, No. 4, 595–599 (1993)

Giacobbe, F. W., "Estimation of Prandtl numbers in binary mixtures of helium and other noble gases," J. Acoust. Soc. Am. Vol. 96, No. 6, 3568–3580 (1994)

Morse, P. M., Vibration and Sound, 2nd ed. (McGraw-Hill, 1948), Chapter VIII.

Powell, M., Grando, R. and Robeson, W., "Performance of a refrigerated charcoal trap for xenon-133," Med. Phys., Vol. 8, 892–893 (1981)

Scarpitta, S. C. and Harley, N. H., "Adsorption and desorption of noble gases on activated charcoal: I. Xenon-133 studies in a monolayer and packed bed," Health Phys., Vol 59, No. 4, 383–392 (1990).

Susalla, M., "Thermodynamic improvements for the Space Thermoacoustic Refrigerator (STAR)," Master's Thesis, Naval Postgraduate School, DTIC Report No. AD A 196 958 (June, 1988)

Swift, G. W., "Thermoacoustic engines," J. Acoust. Soc. Am., Vol. 84, No. 4, 1145–1180 (1988)

Swift, G. W., "Analysis and performance of a large thermoacoustic engine," J. Acoust. Soc. Am., Vol. 92, 1551–1563 (1992)

Underhill, D. W., DiCello, D. C., Scaglia, L. A. and Watson, J. A., "Factors affecting the adsorption of xenon on activated charcoal," Nucl. Sci. Eng., Vol. 93, No. 4, 411–414 (1986)

DRAWING FIGURES

Figure 3:
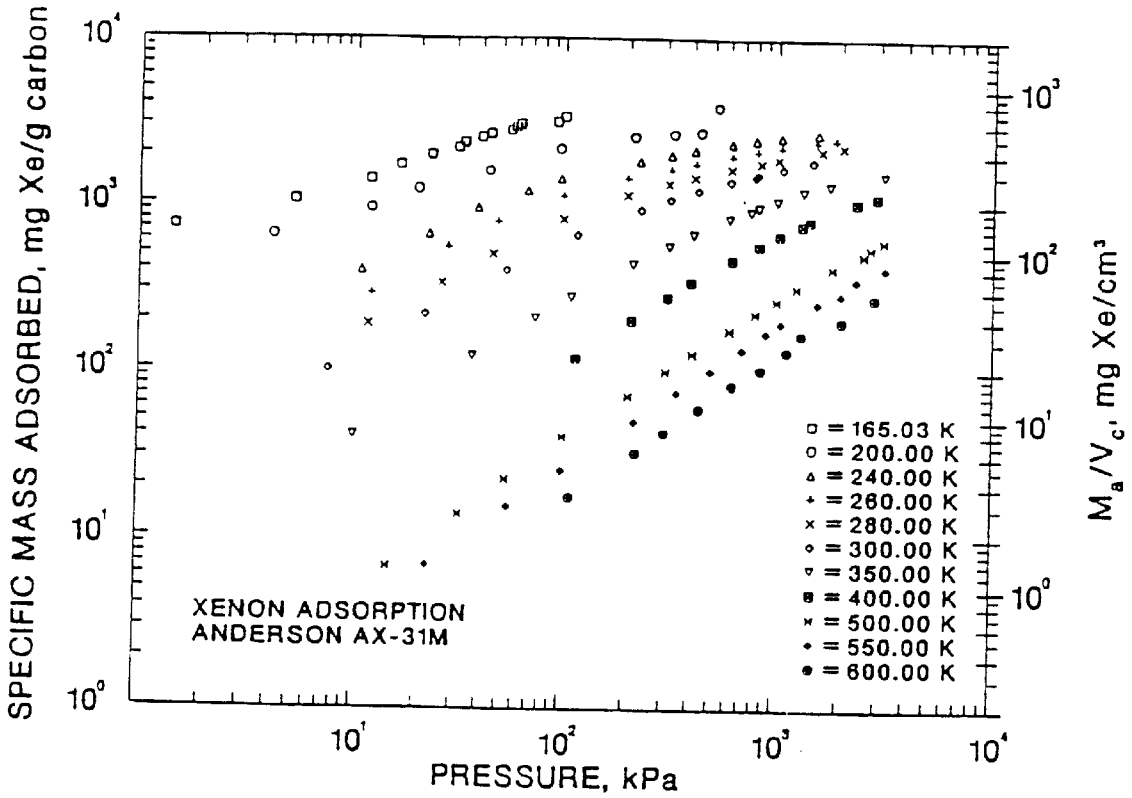

FIG. 3 is a graph of adsorption isotherms for the specific mass of xenon gas (milligrams of Xe per gram of carbon) adsorbed on Anderson AX-31M carbon granules. The AX-31M is simply a brand of activated charcoal chosen for this example. Other brands of activated charcoal, such as Calgon BLP, or other adsorbents such as zeolites, could function as well or better. The graph summarizes measurements at several different temperatures as a function of pressure.

Figure 4:
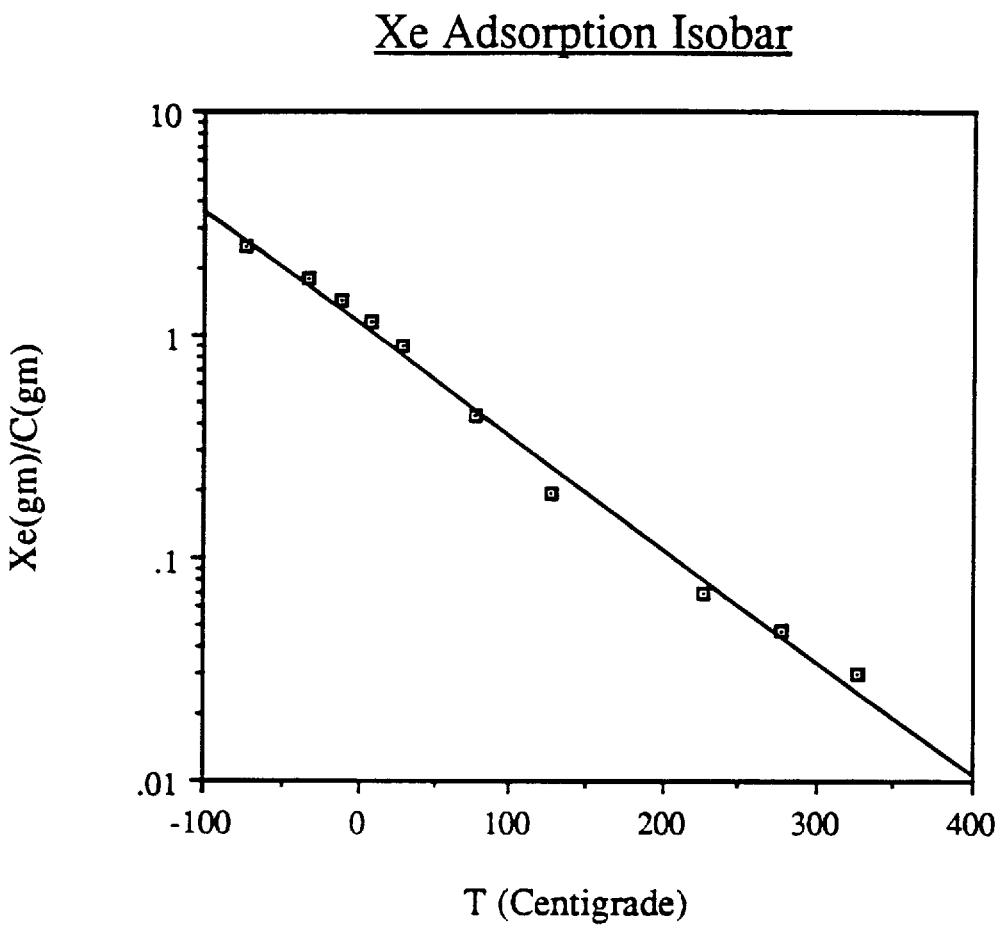

FIG. 4 is a graph of the specific mass of xenon gas (milligrams of Xe per gram of carbon) adsorbed on Anderson AX-31M carbon granules at a fixed pressure of 200 kPa. The graph is derived from the data contained in FIG. 3. The solid line is an exponential curve fit to the plotted data.

REFERENCE NUMERALS IN DRAWINGS

The following is a glossary of elements and structural members as referenced and employed in the present invention.

| | |
|---|---|
| 10 - loudspeaker | 12 - resonator |
| 14 - rigid end cap | 16 - adsorbent |
| 30 - hot heat exchanger | 40 - thermoacoustic stack |
| 50 - cold heat exchanger | 70 - tube |
| 80 - bulb containing adsorbent | 110 - electrodynamic driver |
| 115 - bellows flexure seal | 130 - thermoacoustic resonator |

DESCRIPTION—FIGS. 1 AND 2

Figure 1:
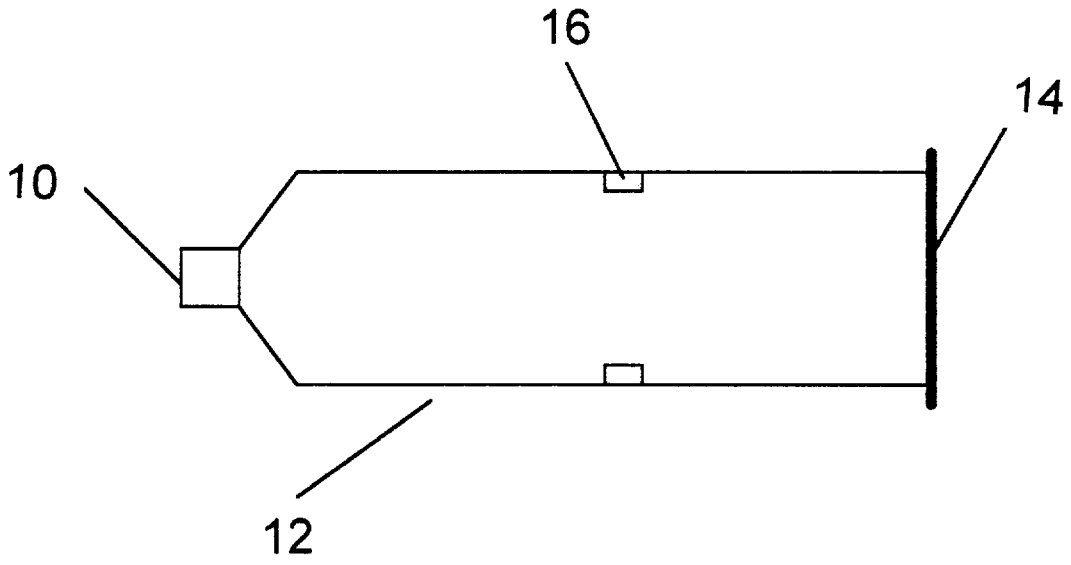
FIG. 1 shows a cross-sectional diagram of an acoustical resonator containing a gas mixture which is excited at its acoustical resonance frequency by a loudspeaker. The resonator contains, at its midplane, a ring of adsorbent material which is in contact with, and permeated by, the gas mixture.

A minimal embodiment of the Passive Frequency Stabilization technique is shown in cross-section in FIG. 1. A loudspeaker 10 seals one end of a cylindrical resonator cavity 12 that is terminated rigidly by an end cap 14 at the end which is opposite loudspeaker 10. Contained within resonator cavity 12 is a mixture of two or more gases which are invisible in this figure, but which fill the interior of the resonator cavity. At the midplane of resonator cavity 12 is a ring of adsorbent material 16 which is within resonator cavity 12 and which is therefore in good physical and thermal contact with the gas mixture contained within the resonator.

Figure 2:
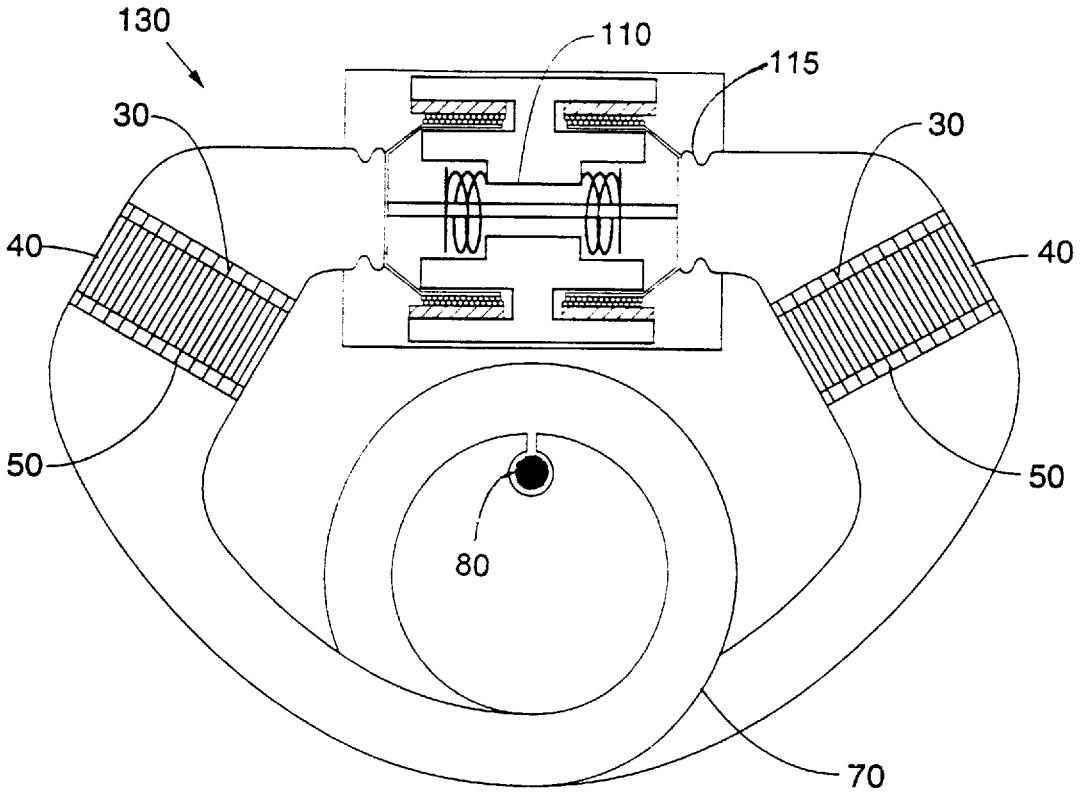
FIG. 2 is a cross-sectional diagram of a complete thermoacoustic refrigerator driven by a double-acting piston which is filled with a gas mixture. An adsorbent is contained within a bulb which is in contact with, and permeated by, the gas mixture.

FIG. 2 shows a typical embodiment of the Passive Frequency Stabilization technique as it might be used in a thermoacoustic refrigerator. This particular thermoacoustic refrigerator design [Garrett, U.S. Pat. No. 5,647,2161] utilizes a single electrodynamic driver 110 with a double-acting piston that is attached to a thermoacoustic resonator 130 by two (bellows) flexure seals 115. Thermoacoustic resonator 130 contains two stacks 40, each of which is in contact with a hot heat exchanger 30 and a cold heat exchanger 50. The two resonator sections which contain each stack 40 and pair of heat exchangers 30 and 50, are joined by a tube 70, which is curved in this particular embodiment to reduce the overall size of the thermoacoustic refrigerator. The entire resonator 130 and electrodynamic driver 110 are filled with a gas mixture which is invisible in this figure. A bulb 80, which contains the adsorbent, is attached to curved tube 70 at its midpoint. This midpoint location is chosen because it is within a cold section of the refrigerator. The adsorbent within bulb 80 is in contact with, and permeated by, the gas mixture which fills resonator 130 and electrodynamic driver 110. When the refrigerator becomes cold it also cools the adsorbent material with bulb 80.

OPERATION—FIGS. 1 THROUGH 4

For simplicity, the following description of the operation of the Passive Frequency Stabilization technique will use only one adsorbent material to match the sound speed of a binary gas mixture at two different temperatures. However, the technique also includes the possibility of matching the sound speed at additional temperatures by use of additional adsorbents and/or additional gases.

Resonance Frequency

For this description of the operating principles, we will consider a simple embodiment of the Passive Frequency Stabilization technique which can be understood by consideration of the gas mixture filled, electrically-driven acoustic resonator of FIG. 1. We can treat loudspeaker 10 as a rigid boundary which can undergo sinusoidal oscillations at some specified frequency, f. The oscillating loudspeaker surface is understood to move in the same direction as the axis of resonator cavity 12. The sinusoidal oscillation of the loudspeaker will generate pressure oscillations of the gas mixture within the resonator.

The other end of resonator 12 is also terminated by rigid end cap 14. This pair of rigid boundary conditions at both ends of resonator 12, dictate that an acoustic standing wave resonance will be generated if the oscillation frequency, f, is chosen so that an integer number, n, of half-wavelengths of the sound, $\lambda/2$, fit between loudspeaker 10 and end cap 14. If length of the resonator is L, which is equal to the distance from the surface of loudspeaker 10 to the surface of rigid end cap 14, then the resonance frequencies will form a harmonic sequence, $f_n = nc/2L$. Although this technique is applicable to all of the acoustical resonances of the resonator 12, including resonances which are not axial, and hence not given by the formula for $f_n$. (More complex modes are described by Morse, *Vibration and Sound,* 2nd ed., Chapt. VIII.) We will focus our attention now on only the lowest frequency (fundamental) axial plane wave resonance which occurs at a frequency, $f_1 = c/2L$.

As described in equation (1), reproduced below, $$c^2=(\gamma R\ T)/M \tag{1}$$

the sound speed, c, is a function of the absolute temperature. In the above example, the frequency, $f_1$, would have to increase, in accordance with equation (1), if the temperature of the gas increased and would have to decrease if the temperature of the gas decreased, in order to maintain the fundamental resonance at $L=\lambda 2$. The change in the resonance frequency can be reduced substantially if the gas within resonator 12 is a gas mixture and if the proper quantity of adsorbent 16, is placed within resonator 12.

Adsorbent Mass Calculation for Frequency Stabilization

In order to stabilize the resonance frequency against changes in temperature, the temperature dependence of the adsorption of at least one of the components of the gas mixture onto the selected adsorbent must differ significantly from that of the other component for the chosen adsorbent. In a thermoacoustic heat engine, this is achieved in practice because the most efficient binary gas mixtures used to date consist of inert gas mixtures such as helium and xenon or helium and argon or argon and neon. Since these gases have substantially different liquefaction temperatures, there are adsorbents which will preferentially adsorb the higher atomic weight gas which has the higher liquefaction temperature as the gas temperature is decreased. For example, at atmospheric pressure, helium ($M_{He}$=4.0026 a.m.u.) liquefies at 4.2° K., while xenon ($M_{Xe}$=131.1 a.m.u.) liquefies at 161° K. At 160° K., all of the xenon would be adsorbed while most of the helium would still be within the resonator in gaseous form.

The expression for the sound speed in a binary mixture of inert (monatomic) requires only a simple modification of equation (1), since $\gamma=5/3$ for all inert gases. If we consider a mixture of two inert gases of atomic masses, $M_A$ and $M_B$, and let the molar concentration of species A be x and that of species B be (1−x), then the mean atomic mass of the gas mixture, $$M_{mean}=x\ M_A+(1-x)\ M_B. \tag{2}$$

The square of the sound speed of the inert gas mixture is then a function of absolute temperature T and molar concentration, x, of species A:

$$c^2(T,x)=5RT/3M_{mean} \tag{3}$$

The expression for the sound speed, c, of more complex gas mixtures, incorporating polyatomic gases as one or more of the gas mixture components, will be considerably more complicated. This is due to the fact that one must also calculate a mean value of the polytropic coefficient, $\gamma_{mean}$. The above expressions (2) and (3), will be sufficient to illustrate the Passive Frequency Stabilization technique. It should be understood that this technique will work equally well with gas mixture which require a more complex expression for sound speed variation with temperature and mixture concentration, but it will be easier to describe the technique without introducing these additional complications which might obscure its application to the novice practitioner.

We can now select two different temperatures, $T_1$ and $T_2$, at which we would like the speed of sound to be equal. Since the resonance frequency is directly proportional to the sound speed, this will also make the resonance frequencies at these two temperatures equal, $f(T_1)=f(T_2)$. At $T_1$, the initial concentration $x_1$ is set by equations (2) and (3). One can then use the same to equations to calculate the concentration, $x_2$, which makes the sound speeds at the two temperatures equal, so that $c(T_1, x_1)=c(T_2, x_2)$. Knowing the required difference in concentration of species A and the volume and pressure of the gas mixture within the resonator, one can easily calculate the required change in mass of species A, $\Delta m_A$.

All that remains to implement the Passive Frequency Stabilization technique at this point is the choice of the proper adsorbent. Adsorbents can be characterized by the ratio, $w_a$, of the mass of adsorbed gas to the mass of adsorbent. For a suitable adsorbent, the temperature dependence of $w_a$ will be large for component A and small for component B in the gas mixture. The mass of adsorbent material required to remove the mass $\Delta m_A$ from the mixture, in order to stabilize the resonance frequency at the two temperatures, can be calculated from the value of $w_a$ at the two temperatures at which the resonance frequencies were made equal.

$$m_a=\Delta m_A/[w_a(P_1, T_1)-w_a(P_2, T_2)] \quad (4)$$

In most applications, $P_1 \approx P_2$, and almost all of the variation in $w_a$ will be due to the change in temperature so that $[w_a(P_1, T_1)-w_a(P_2, T_2)] \approx [w_a(P_1, T_1)-w_a(P_1, T_2)]$. The required mass, $m_a$, of the adsorbent material can then be placed within the resonator using some suitable fixture. In FIG. 1, that fixture for adsorbent is shown as ring 16 and in FIG. 2 that fixture is shown as bulb 80.

In a thermoacoustic device, the adsorbent should be located near a velocity antinode of the standing wave. In a thermoacoustic refrigerator, heat is pumped away from the velocity antinode toward the pressure antinode. The velocity antinode is therefore at a location within the thermoacoustic resonator which becomes cold. The cooling of the adsorbent at that location will serve to selectively remove the component of the gas mixture which has the higher atomic or molecular weight. Although location of the adsorbent at or near the velocity antinode is ideal, the adsorbent could be located in any portion of the thermoacoustic refrigerator which is cooled. In the embodiment shown in FIG. 2, the adsorbent could be located anywhere in tube 70, up to, and including, application of the adsorbent directly to one or both cold heat exchangers 50.

If the fixture is located at a pressure node of the standing wave, the National Institutes for Standards and Technology has been demonstrated experimentally that the adsorbent produces a minimal degradation of the quality factor of the resonance [Berg, Section D of "Properties of working fluids for thermoacoustic refrigerators," submitted to the Office of Naval Research under contracts PE 61153N, G N00014-93-F-0101, and TA 3126974 (1996)]. It is fortunate that one would never choose to locate the adsorbent at a pressure antinode since it would destabilize the frequency rather than stabilize the frequency.

EXAMPLE

In order to make the application of this technique clear and to illustrate its inherent simplicity, the following example is provided. Consider a thermoacoustic refrigerator of the type shown in FIG. 2. It has been designed to operate as an air conditioner at a fixed frequency of 60 Hz. In order to optimize the efficiency of this thermoacoustic air conditioner, a gas mixture consisting of approximately 10% xenon and 90% helium is to be used. Since the operating temperature of the refrigerator is variable, the temperature dependence of the sound speed, as shown in equation (3), suggests that the system cannot be maintained at resonance if the concentration of the xenon concentration in the gas mixture remains fixed when the temperature changes from the start-up value to the final operating temperature. Operation at resonance is important because it increases efficiency and heat pumping power, simplifies the design of electrodynamic driver 110, and because the design of the refrigerator, and hence its performance, was based on the specific location of stacks 40 at a fixed value of kx, where x is the distance of the mid-point in the stack from the driver and k is the wavenumber, $k=2\pi f/c=2\pi/\lambda$. Since the position of the stack is fixed, k must also remain constant. If the oscillation frequency of electrodynamic driver 110 is fixed, then there are only two options which allow the system to be maintained at resonance as the temperature is changed. One is to change the length of the resonator and the other is to change the speed of sound in the working fluid (i.e., the gas mixture).

Due to the requirement that radioactive gases produced by nuclear power generation be controlled, a large amount of research has been done in the area of selective "scrubbing" of these gases by carbon cryo-adsorbtion [e.g., Scarpitta, et al, Health Phys., Vol. 59, No. 4, 383–392 (1990); Powell, et al., Med. Phys., Vol. 8, 892–893 (1981); Underhill, et al., Nucl. Sci. Eng., Vol. 93, No. 4, 411–414 (1986)]. FIG. 3 shows a typical set of adsorption isotherms for xenon on carbon [e.g., activated charcoal, Anderson AX-31M]. For this example, the air conditioner is designed for a working fluid (gas mixture) static pressure of 2.0 MPa, and the xenon mole fraction is approximately 10%. Therefore, it is convenient to estimate the temperature dependence of the specific mass adsorbed at the xenon partial pressure of 200 kPa. The temperature dependence, $w_a(T, P=200 \text{ kPa})$, is shown in FIG. 4, which exhibits an approximately exponential dependence on pressure, as shown by the solid line "least-squares" fit to the data points ($Xe/C=1.13\ e^{-0.00506\ T/(°C.)}$). This exponential behavior with temperature is expected from an activation energy model of the adsorption process.

It is important to point out that the use of Anderson AX-31M as the adsorbent is entirely arbitrary. Almost any material which has a high ratio of surface area to volume would be useful. Activate charcoal, such as Anderson AX-31M or Calgon BPL, are good choices since activated carbon is inexpensive, readily available, and chemically inert. This would also be true of materials classified as "molecular sieves" such as Zeolite.

The ability to reduce the amount of xenon in the mixture by the temperature dependence of charcoal adsorption can be exploited to solve the problem of maintaining the operation of the engine at the acoustical resonance frequency of 60 Hz. This can be accomplished by changing the concentration of the mixture to compensate for the change in the sound speed with temperature as suggested in equation (3). Such a scheme is particularly attractive, since it requires neither an active control system nor moving parts. Although the functional dependencies of the sound speed and the adsorption, on temperature, are not exactly complementary, it is possible to satisfy the resonance condition exactly at the two temperature extremes. The performance at intermediate temperatures would be entirely satisfactory.

In order to choose the required mass of carbon necessary to keep the system at resonance under conditions of changing temperature, the total volume of gas mixture in resonator 130 must be known. Although the exact volume will depend upon the amount of gas mixture contained within electrodynamic driver 110, the fact that the driver volume is small and the gas mixture contained within the driver can only communicate with resonator 130 via the small capillary leaks, will make the driver's contribution negligible for the purposes of this example. Neglecting the driver volume, the total volume of resonator 130 is approximately 21.5 liters ($2.15\times10^{-2}m^3$).

Based on the ideal gas law, PV=vRT, the thermoacoustic resonator volume requires the engine to contain v=16.8 moles of mixture at a pressure of 2.0 MPa, when it starts-up at an absolute temperature of 308° K. (35° C.). The sound speed in the mixture at that temperature, based on equations (2) and (3), is 485 m/sec. Since xenon represents 11% of the mixture under the start-up condition, a total mass of 242 gm (1.846 moles) of xenon is required. If we assume that the air conditioner operates at 6° C. (279° K.), then solution of equations (2) and (3) for the required xenon concentration to produce the same sound speed at 6° C. as at the start-up temperature, yields a xenon molar concentration of 9.8%. The difference in the specific mass adsorbed at those two temperatures is 0.15 $gm_{Xe}/gm_c$, so that 178 gm of Anderson AX-31M activated charcoal would be adequate to fix the sound speed at those two temperatures. The results of these calculations are summarized in the table below:

| | Operation | Start-up |
|---|---|---|
| Temperature (°C.) | +6 | +35 |
| Xenon concentration (%) | 9.8 | 11.0 |
| Sound Speed (m/sec) | 485 | 485 |
| Specific mass adsorbed | 1.096 | 0.947 |
| Xenon mass in resonator (gm) | 216 | 242 |
| Xenon mass in carbon (gm) | 195 | 169 |
| Total xenon mass (gm) | 411 | 411 |

While the above example used a specific mixture of helium and xenon and a specific brand of carbon adsorbent, the invention can be used with any other inert gas mixture such as helium and argon or neon and krypton and could also be used in gas mixtures which combine an inert gas such as helium with a non-inert gas such as sulphurhexafluoride, or a mixture of non-inert gases such as hydrogen and methane. Similarly, the adsorbent could be a zeolite instead of an activated charcoal and could, in fact, be a metalic sponge or sinter, or a porous ceramic.

SUMMARY, RAMIFICATIONS, AND SCOPE

Accordingly, the reader will see that the Passive Frequency Stabilization technique, which utilizes an adsorbent in contact with a gas mixture within an acoustic resonator, can be used to keep the acoustic resonance frequency very nearly constant, even though the temperature of the gas mixture, resonator and adsorbent are changing.

The reader should also appreciate the simplicity of this invention, which avoids active control systems requiring additional components, such as sensors and signal processing electronics, and can avoid the necessity for costly amplifiers to drive loudspeakers in thermoacoustic refrigeration applications. An additional advantage is the fact this invention utilizes gas mixtures which have already been shown to be advantageous in thermoacoustic applications due to the improved efficiency of working fluids which have Prandtl Numbers that are smaller that the Prandtl Numbers of pure gases. It has also been claimed elsewhere that gas mixtures simplify the design of both the resonator and the coupling of the electroacoustic transducer to the acoustically resonant load.

Although the description above contains many specificities, these should not be construed as limiting the scope of the invention, but as merely providing illustrations of some of the presently preferred embodiments of this invention. The focus of the specification, drawings, and example has been on the application of this invention to thermoacoustic refrigerators, due to the immediate interest and motivation of the inventor. It should be clear that the Passive Frequency Stabilization technique has far wider applicability, not only to thermoacoustic prime movers, but to acoustical systems such as sonic compressors, which contain no thermoacoustic elements (e.g., stacks or heat exchangers).

Thus, the scope of the invention should be determined by the appended claim and its legal equivalents, rather than by the examples given.

I claim:

1. An apparatus having a temperature stabilized acoustic resonant frequency at a first and a second temperature, the apparatus comprising:

an acoustic resonator having a cavity;

a mixture of two or more gases contained within said cavity; and an adsorbent material in fluid contact with said gases, the adsorbency of said adsorbent material having a temperature dependence which is a different function of temperature for each of said two or more gases.

2. The apparatus of claim 1, wherein said mixture consists essentially of two gases.

3. The apparatus of claim 1, wherein said gases comprise inert gases.

4. The apparatus of claim 3, wherein said gases are helium and xenon.

5. The apparatus of claim 4, wherein the molar percentage of xenon is in the range of 1 to 40% and the molar percentage of helium is in the range of 60 to 99%.

6. The apparatus of claim 4, wherein the molar percentage of xenon is in the range of 8 to 12% and the molar percentage of helium is in the range of 88 to 92%.

7. The apparatus of claim 1, wherein said adsorbent material is disposed within said cavity near a location corresponding to a velocity anti-node.

8. The apparatus of claim 1, wherein said adsorbent material is a molecular sieve.

9. The apparatus of claim 1, wherein said adsorbent material is activated carbon.

10. The apparatus of claim 9, wherein said adsorbent material is zeolite.

11. The apparatus of claim 1, wherein said gases are selected from the group consisting of inert gases, sulfur hexafluoride, halocarbons, and combinations thereof.

12. A method for providing an acoustic resonator having a temperature stabilized acoustic resonant frequency at a first and a second temperature, the method comprising the steps of:

a. providing an acoustic resonator having a cavity;

b. disposing a mixture of two or more gases within said cavity;

c. disposing an adsorbent material in fluid contact with said gases, the adsorbency of said adsorbent material having a temperature dependence which is a different function of temperature for each of said two or more gases.

* * * * *